US005090458A

United States Patent [19]

Creeron

[11] Patent Number: 5,090,458

[45] Date of Patent: * Feb. 25, 1992

[54] CLEANING APPARATUS AND METHOD

[75] Inventor: Richard F. Creeron, Valley Stream, N.Y.

[73] Assignee: First Brands Corporation, Danbury, Conn.

[ * ] Notice: The portion of the term of this patent subsequent to Aug. 21, 2007 has been disclaimed.

[21] Appl. No.: 531,735

[22] Filed: May 24, 1990

Related U.S. Application Data

[63] Continuation of Ser. No. 200,347, May 31, 1988, Pat. No. 4,949,765.

[51] Int. Cl.[5] ..... B65B 3/12

[52] U.S. Cl. ..... 141/7; 141/92; 141/59; 141/65; 134/169 A

[58] Field of Search ..... 141/7, 59, 60, 61, 65, 141/89, 90, 91, 92; 134/169 A

[56] References Cited

U.S. PATENT DOCUMENTS

| | | | |
|---|---|---|---|
| 2,187,413 | 1/1940 | Boezi et al. | 134/169 A X |
| 3,034,521 | 5/1962 | Greenfield | 134/169 A X |
| 3,094,131 | 6/1963 | Williams | 134/169 A X |
| 3,425,464 | 2/1969 | Hughes | 141/7 |
| 4,149,574 | 4/1979 | Lehmann et al. | 141/59 |
| 4,276,914 | 7/1981 | Albertson | 134/169 A X |
| 4,293,031 | 10/1981 | Babish et al. | 134/169 A X |
| 4,793,403 | 12/1988 | Vataru et al. | 165/95 |
| 4,949,765 | 8/1990 | Creeron | 141/7 |

OTHER PUBLICATIONS

Sales Brochure entitled "Lincoln's New Portable Air Operated, Fluid Evacuation System for Industrial, Automotive and Marine Applications", Copyright 1988.

*Primary Examiner*—Ernest G. Cusick
*Attorney, Agent, or Firm*—Gary L. Wamer

[57] ABSTRACT

A radiator flush/fill apparatus and process employing a flushing apparatus having a modified radiator cap, a pumping device and an automobile radiator containing a liquid, wherein the flushing apparatus comprises a modified radiator cap having an elongated hollow tubular member forming an elongated open fluid passageway through the modified radiator cap and extending into the automobile radiator for accessing the liquid present in the automotive cooling system; with one end of the elongated tubular member adapted to engage in a fluid tight relationship a connecting device connected to a pumping device for removing a major amount of the liquid from the automobile radiator through the elongated tubular member and for replacing the removed liquid by introducing a new liquid through the elongated tubular member.

19 Claims, 2 Drawing Sheets

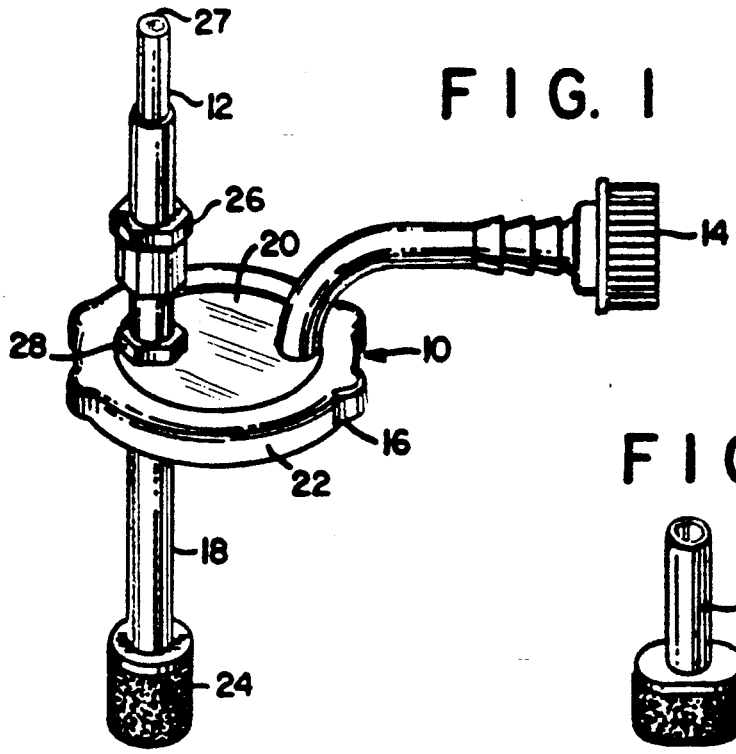
FIG. 1
FIG. 3
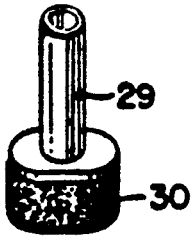
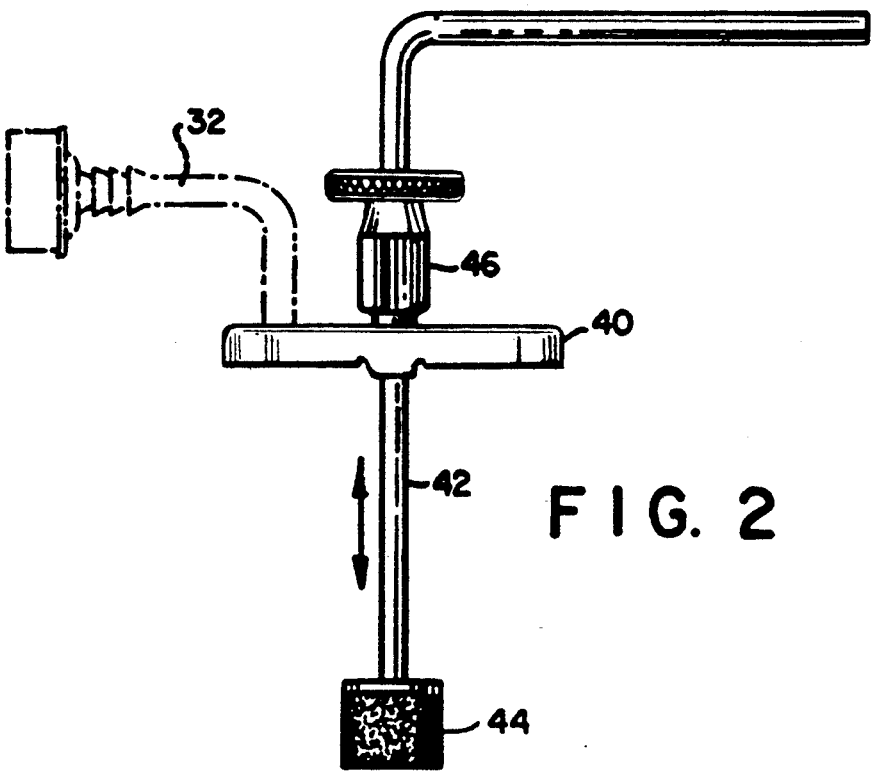
FIG. 2

CLEANING APPARATUS AND METHOD

This application is a continuation of prior U.S. application Ser. No. 200,347, filing date May 31, 1988 U.S. Pat. No. 4,949,765.

FIELD OF THE INVENTION

The instant invention relates to a method and apparatus for emptying, flushing and filling automobile cooling systems.

BACKGROUND OF THE INVENTION

The prior art methods and apparatus for flushing and filling automotive radiators is replete with diverse methods and apparatus for use in removing spent or vintage antifreeze/coolant, flushing the radiator with a flush liquid and filling the radiator with new antifreeze/coolant. Although numerous methods and apparatus have been devised to accomplish this process, these methods have had common features associated with the removal and introduction of antifreeze/coolant from and to the radiator. The "change-over" from used antifreeze/coolant has heretofore involved the introduction of a flushing liquid at the opening associated with the radiator cap while a second opening is present for the removal of the spent antifreeze/coolant from the radiator. The second opening may be the drain plug at the bottom of the radiator or may be an opening formed by cutting or removing one of the hoses found in the automotive cooling system. Although the aforementioned general flush/fill process has been used for many years, such process is not without its problems. For example, when the second opening is the drain plug the contents of the cooling system that is flushed is generally only a portion of the total volume of the cooling system, since the thermostat of the automobile remains closed when in contact with the cool flushing water and further, some of the antifreeze/coolant is trapped in the engine. The new antifreeze/coolant is added to the cooling system and is necessarily admixed and contaminated with a significant amount of the spent antifreeze/coolant. When the second opening is formed by cutting or removing one of the hoses associated with the cooling system several problems arise. First, owing to the complexity of modern automotive systems it is not always clear which hose to cut or remove for access to the cooling system. The myriad of hoses associated with numerous separate and distinct automotive cooling systems has generated considerable confusion as to how to gain access to the automotive cooling system. Further, if the flush/fill process is being conducted as a commercial enterprise the cutting and/or removal of a cooling system hose creates significant practical and financial burdens. The additional cost associated with cutting/removal of the hose, replacement of the hose and the cost of a new hose must be passed on to the customer. Further, a large inventory of hoses must be maintained to accommodate the large number of makes and models of automobiles to be serviced. Further, the inevitable cutting of the wrong hose creates a delay in completing the flush/fill process and requires additional effort for locating a replacement hose. This time is generally at the expense of a customer who is waiting on the automobile and other customers awaiting service.

Although the aforementioned problems may appear trivial for the "do it yourselfer", these problems become quite significant when the flush/fill process is associated with a commercial flush/fill operation. The public's demand for fast and efficient service does not allow for significant increases in the predicted time and estimated cost for completion of the flush/fill service.

The instant invention overcomes the problems associated with the prior art flush/fill process by eliminating the need for opening the drain plug and/or cutting-/removing hoses associated with the cooling system. A modified radiator cap and pumping means are employed which permit the removal of spent antifreeze/-coolant and, optionally, flushing fluid and the introduction of new antifreeze/coolant via the modified radiator cap and introduction of new antifreeze/coolant.

DESCRIPTION OF THE DRAWING

FIG. 1 is a perspective view of the radiator flushing-/filling apparatus of the instant invention.

FIG. 2 is a side elevational view of the radiator flushing/filling apparatus of the instant invention.

FIG. 3 is a fragmentary perspective view of a pliable member associated with the radiator flushing/filling apparatus.

SUMMARY OF THE INVENTION

Figure 4:
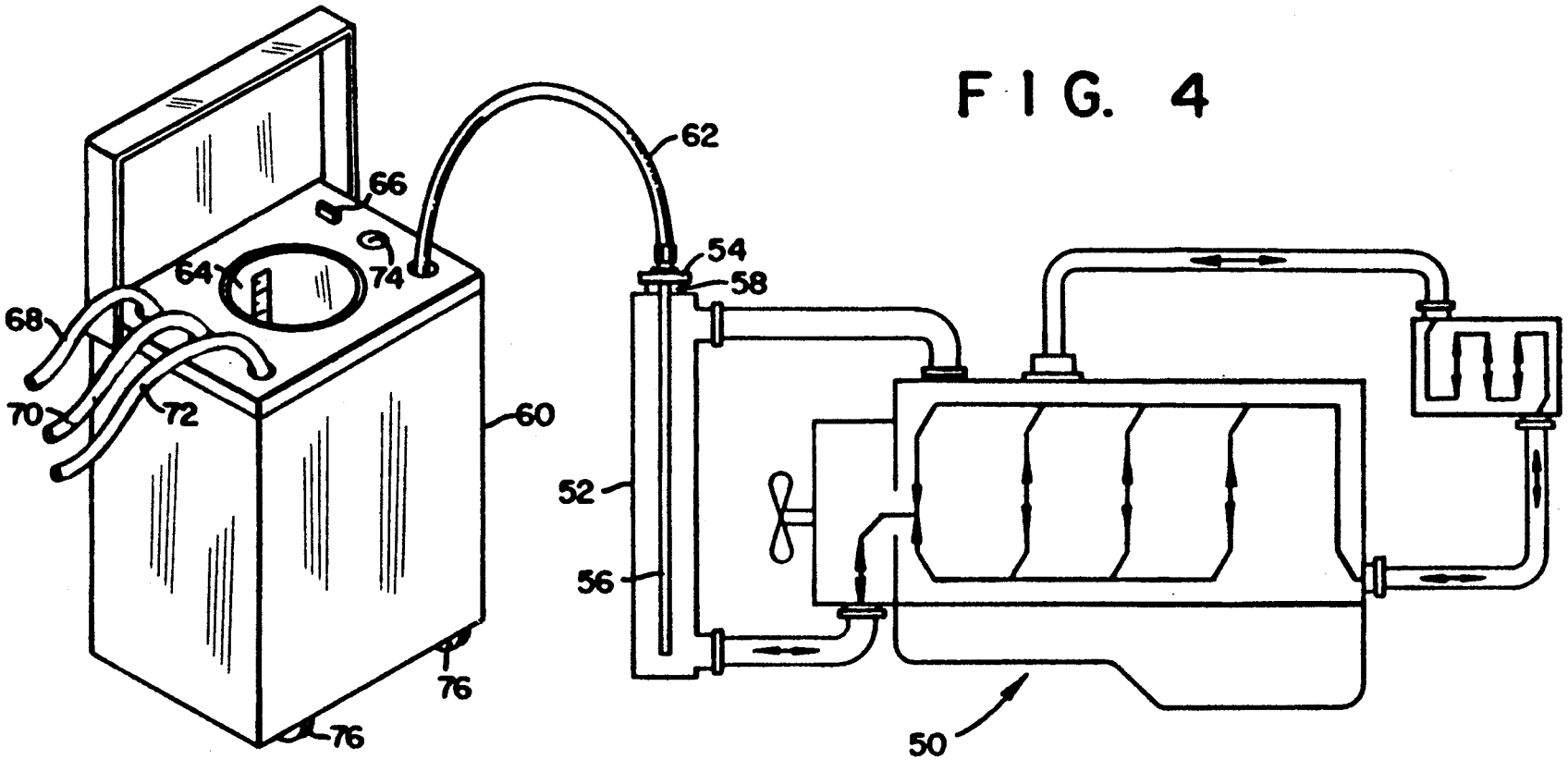
FIG. 4 is a perspective view of the apparatus of the invention associated with an automotive cooling system of an internal combustion engine.

The instant invention relates to a radiator flushing apparatus for an automotive cooling system in combination with a hose ("connecting means") connected to a pumping means and an automobile radiator containing a liquid, wherein the radiator apparatus comprises: a modified radiator cap having an elongated hollow tubular member forming an elongated open fluid passageway through the modified radiator cap unit and extending into the automobile radiator for accessing the liquid; a connecting means connected to one end of the elongated tubular member and connected to the pumping means in a fluid tight relationship; pumping means for removing a major amount of the liquid from said automobile radiator through said elongated tubular member for replacing said removed liquid by introducing a liquid through said elongated tubular member. In addition, an intermediate step may be employed wherein a flushing liquid is introduced into the automotive cooling system and removed prior to replacing the liquid in the system with the final liquid. Further, the process by which the removal of liquid and replacement of liquid is achieved is carried out by employing a pumping means to remove liquid from the automotive cooling system and a pumping means to introduce liquid to the radiator.

DETAILED DESCRIPTION OF THE INVENTION

In one respect the invention relates to a flushing apparatus for an automobile in combination with a pumping means and an automotive cooling system and having a radiator containing a liquid, wherein the flushing apparatus comprises a modified radiator cap having an elongated hollow tubular member forming an elongated open fluid passageway through the modified radiator cap unit and extending into the automobile radiator for accessing the liquid; connecting means, e.g., a hose, connected to one end of the elongated tubular member and connected to pumping means and adapted to engage the elongated tubular member in a fluid tight relationship; pumping means for removing a major amount of the liquid from said automobile radiator through said elongated tubular member for replacing said removed liquid by introducing such through said elongated tubular member. The process comprising a) removing liquid from the radiator through said tubular member using said pumping means;

b) introducing liquid to the radiator through said tubular member using said pumping means.

In a further embodiment the process comprises a process for flushing an automotive radiator using a radiator flushing apparatus in combination with a pumping means and an automobile radiator having an over-flow container, both containing an antifreeze/coolant liquid, wherein the flushing apparatus is as above described.

The instant flush/fill process is advantageous in that there are no hoses to cut and no petcock or drain to locate and open. The complete process takes place using a pumping apparatus (means) at the radiator cap. The process enables removal of the old antifreeze/coolant from the automotive cooling system ("system") (including the recovery bottle or "over-flow container"), providing a flushing agent via the over-flow container followed by a water flush, and, finally, introduction of antifreeze/coolant to the automotive cooling system. The time frame for the entire flush/fill process is generally less than fifteen minutes.

This flush/fill process is new, efficient and easily accomplished. The procedure is preferably initiated and carried out when the vehicle is warm and, accordingly, when the thermostat is open. Because the system is warm and may be under pressure, the operator carrying out the process must be protected from possible burns from hot liquids. The temperature of the system is determined by checking a hose connected to the system for temperature and pressure. If the hose is hard and warm, the hose is probably under pressure. The operator should protect himself by covering the radiator cap with a thermal bag and secure it to the radiator neck with a fastening means, e.g. a ponytail band. The air is squeezed from the bag before securing the thermal bag to the radiator neck. The operator then twists or opens the cap counterclockwise (wearing protective gloves) to the first notch of the system to vent pressure. Hot coolant and steam will vent into the recovery bottle and/or thermal bag. Once the system is vented, the bag and hot radiator cap can be removed together.

The pumping apparatus or means may be independently powered or powered from the car battery. A water supply is connected to the pumping means and a source of antifreeze/coolant may also be connected to the pumping means, as hereinafter described. The machine is connected to the system via a modified radiator cap, as hereinafter described. Since there are two types of radiators (cross-flow and down-flow) associated with automobiles, the appropriate modified radiator cap must be selected. Most radiators are cross-flow units, i.e., the radiator cap is located on the extreme right or left and its tubes are horizontal. These radiators are found on automobiles manufactured by General Motors and most automobiles manufactured by Ford and Chrysler. The header tanks on cross-flow radiators are deep and are the same elevation as the radiator. The other commonly used type of radiator is called a down-flow type. These radiators have a radiator cap in the middle and on the top of the unit. Most Japanese automobiles use this design as do some vans manufactured by Ford, large automobiles manufactured by Chrysler cars and most older automobiles. These down-flow radiators have a shallow header tank and when empty the vertical tube openings can be viewed.

Radiator filler necks on the down-flow and cross-flow radiators typically come in two diameters. Perhaps 95% of all automobiles are one size. Some later model foreign automobiles use a smaller size cap and these are generally down-flow type radiators.

The pumping apparatus is typically connected to the modified radiator cap via a flexible nylon tubing.

FLUSH/FILL PROCESS WITH A CROSS-FLOW RADIATOR

Using the proper diameter modified radiator cap the metal tubing is passed through it via an opening from the top of the modified radiator cap. The tube is inserted into the filler neck of the radiator until it reaches the bottom of the radiator. It may be necessary in some instances to maneuver the tube past the transmission oil cooler located in the radiator. The modified radiator cap is then placed on the filler neck of the radiator and secured. The tube is then secured in place with a tube tightening means, e.g. a locking wing nut.

The pumping apparatus is then started whereby liquid contents are removed from the system until the over-flow container is substantially empty. Although a flushing step (cleaning step) is not required, it is preferable to use a cleaning flush to clean the radiator of rust and other matter. A flushing agent (such as those commercially available) is placed in the over-flow container. The pumping apparatus is started and the flushing agent drained into the radiator. The pumping apparatus is stopped once the flushing agent empties from the over-flow container. The engine is then started and run for about one to ten minutes, preferably about five minutes. The engine is then stopped and the pumping apparatus operated to remove the liquid from the radiator until the liquid pumping from the radiator is complete, e.g., as indicated by having substantially no liquid draining from a drain outlet of the pumping apparatus.

The system is now flushed with water via introduction of water from the pumping apparatus. The system is deemed full when the recovery bottle starts to fill with water. When the system is full, the introduction of water is stopped and the engine is started and run for about one to about 4 minutes, preferably about two minutes. The water is removed from the system by the pumping apparatus in the same manner as the old coolant/flushing agent was removed.

The concentration of antifreeze/coolant for the system is determined and the appropriate amount (concentration) of antifreeze/coolant placed into the reservoir of a pumping apparatus and pumped into the automobile cooling system. Once the antifreeze/coolant has been pumped into the radiator, additional water may be added to completely fill the system. The introduction of water is stopped when the recovery bottle is full. The over-flow container is preferably filled to a level above the lines thereon indicating it is full. This extra antifreeze/coolant is provided to fill any air pockets in the system as a result of the flush/fill process. The modified radiator cap is then removed and the original radiator cap replaced.

DOWN-FLOW RADIATORS

Down-flow radiators use essentially the same radiator cap as do the cross-flow radiators. However, with a down-flow radiator, a vertical tube of radiator is used like a straw to remove the antifreeze/coolant from the bottom of the radiator and the automotive cooling system. A metal tube with the round or oblong pliable rubber end is placed through the modified radiator cap and over the selected vertical radiator tube. After picking the vertical radiator tube to be used, the rubber end of the metal tube is placed over it. The modified radiator cap is then placed on the filler neck of the radiator and secured. The metal tube is held firmly against the vertical radiator tube and secured in place relative to the modified radiator cap with a wing nut or appropriate securing means. The pumping apparatus is started and the antifreeze/coolant removed as before. The remaining procedure for the flush/fill process is now as explained above for a cross-flow radiator.

DESCRIPTION OF THE DRAWINGS

The aforementioned general description of the instant apparatus and process shall be more fully described by reference to the drawings:

As can be seen by reference to the drawings and in particular to FIG. 1, FIG. 2 and FIG. 3, the flushing apparatus that forms a part of the present invention is designated generally by the reference numeral 10. The flushing apparatus 10 comprises in general a modified radiator cap 11, a connecting means 12 (shown as a hose) and optionally, a pressure gauge (not shown) connected at 14. These items will now be described in seriation fashion.

FIG. 1 shows a modified radiator cap 10 comprises a radiator cap member 16 having a disposed elongated hollow tubular member 18 therein projecting through the top 20 and the bottom (not shown) of the radiator cap member 16, and disposed in a fluid tight relationship with respect thereto. In addition, the radiator cap member 16 is further provided with a depending L-shaped skirt portion 22 that releasably engages the mouth of an automobile radiator (not shown) in a well recognized fashion. The elongated hollow tube member inserted into the radiator may be fitted with soft pliable member 24 to provide improved contact of the tube member with surfaces inside the radiator, although such is not required. This member 24 is shown in FIG. 1 as a generally round member, as is the case when used in conjunction with a cross-flow radiator. FIG. 3 depicts an oblong or oval shaped member 30 appropriate for use with a down-flow radiation, as hereinbefore described. Once the tube member has been inserted into the radiator at the desired distance it may be locked in place by locking means 26 which locks to locking means 28 on radiator cap member 16.

As can be seen by reference to FIG. 1 the elongated hollow tubular member 18 forms an open fluid passageway 27 through modified radiator cap 16. The outboard end (end outside the radiator) of the elongated hollow tubular member 18 comprises a female hose coupling member 12 for connection to a pumping means (shown in FIG. 4). The female hose coupling member 12 may be further provided with an enlarged external friction surface or may have a threaded bore (not shown).

As shown in FIG. 1 the hose coupling member 12 is provided to establish open fluid communication between a connecting means (not shown) connected to a source that can provide for removal and introduction of liquids from and to the interior of the automobile radiator and automotive cooling system, as previously discussed and as described hereinafter in relation to FIG. 4.

FIG. 3 is similar to FIG. 1, except the modified radiator cap is not provided with an outlet (shown in phantom as member 40) for attachment of a pressure guage. The embodiment shown in FIG. 3 is well suited for use with a down-flow radiator where the length of the hollow elongated tube 42 having pliable member 44 is relatively short, since pliable member 44 is to be placed over and in substantially fluid tight relationship with one of the down-flow tubes of the radiator. In this embodiment the pliable member is preferably of the type shown in FIG. 3. The portion of the hollow tube extending above (shown as 44) the radiator cap 40 may be adjusted and secured in place using securing means 46, shown as a wing nut that tightens around the hollow tube as it is screwed downward.

Referring to FIG. 1, it can be seen that the female hose coupling member 12 is dimensioned to be engaged by a complementary male member (not shown) and to form a fluid tight seal therebetween. The male member will in most instances be a hose, e.g., a nylon hose, connected to a pumping means.

A resilient sealing gasket (not shown) is typically employed to engage the surface of the radiator when connected to the inlet neck of an automobile radiator. When the apparatus is operatively engaged with an automobile radiator, the modified radiator cap is brought into fluid tight sealing engagement with the periphery of the radiator inlet (not shown), whereby under normal operating conditions such provides a generally liquid tight fluid connection between the modified radiator cap and the automotive radiator.

Referring to FIG. 4, an automotive cooling system 50 is shown having radiator 52 with a liquid over-flow container (not shown). A modified radiator cap 54 having an elongated hollow tube member 56 (substantially as described in FIG. 1) is connected to the inlet 58 of radiator 52. Pumping means 60 is connected to modified radiator cap 54 via connecting hose 62 whereby the pumping means may pump liquid to and from the automotive cooling system. The pumping means is of conventional design as to the liquid pumps associated with the pumping means used to pump liquids to and from the automotive cooling system. In one embodiment the pumping means is provided with a plurality of pumps for pumping the various liquids encountered during the flush/fill process, although a single pump may be employed. The pumping means may be provided with a reservoir 64 for introduction of water or new antifreeze/coolant and switching means 66 for alternating between the individual liquid removal and introduction process steps. Such switching means have associated valves and gauges as generally and readily apparent to those skilled in the art. For example, U.S. Pat. Nos. 4,293,031 and 4,276,914 depict the nature of such alternating selection and of such flow diverting valves, said patents incorporated herein in their entirety by reference thereto. The discharge hose 68 and a water inlet 70 (shown as a hose) and a liquid inlet 72 (shown as a hose) for introduction of antifreeze/coolant to the reservoir prior to introduction to the automotive cooling system. In one embodiment the pumping means has a pressure sensing means 74 which is connected to modified radiator cap 54, as discussed in relation to FIG. 1 and FIG. 2.

The pumping means depicted in FIG. 4 is shown as an encased unit placed on rollers 76. Alternatively, pumping means 76 may fixedly be mounted in a servicing installation with flexible and movable hoses used to connect the pumping means to the modified radiator cap and associated automotive radiator.

Having thereby described the subject matter of this invention, it should be obvious that many substitutions, modifications, variations, and reversal of parts are possible in light of the above teachings. It is therefore to be understood that the invention as taught and described herein, is only to be limited to the extent of the breadth and scope of the appended claims.

I claim:

1. A process for flushing/filling an automotive cooling system using a flushing apparatus having pumping means, liquid switching means and having an elongated hollow tubular member for flushing/filling an automotive cooling system having an automobile radiator having a neck opening, said automotive cooling system containing a first liquid to be replaced with a second liquid wherein the process comprises forming an elongated open fluid passageway extending into the automobile radiator through the neck opening for accessing said first liquid, one end of the elongated hollow tubular member adapted to engage in a fluid tight relationship said pumping means in communication with said switching means for removing first liquid from said automotive cooling system through said elongated hollow tubular member and for introducing said second liquid through said elongated hollow tubular member, said process comprising:

a) removing said first liquid from said automobile radiator through said elongated hollow tubular member using said pumping means through said switching means;

b) introducing said second liquid to said pumping means and to said elongated hollow tubular member through said liquid switching means to said pumping means; and c) introducing said second liquid to said automobile radiator through said elongated hollow tubular member using said pumping means and said liquid switching means.

2. A process according to claim 1 where the process additionally comprises the following steps:

a) removing said antifreeze/coolant first liquid from the automotive cooling system;

b) introducing a cleaning liquid or a substantially neutral liquid into the automotive cooling system;

c) removing said cleaning liquid or said substantially neutral liquid from said automotive cooling system through said elongated hollow tubular member using said pumping means and switching means prior to introducing said second liquid to said automotive cooling system; and d) introducing said antifreeze/coolant second liquid to said automotive cooling system through said elongated hollow tubular member using said pumping means and switching means.

3. A process according to claim 2 wherein said substantially neutral liquid is water.

4. A process according to claim 2 wherein said cleaning liquid is a flushing agent.

5. A process according to claim 4 wherein said flusining agent is effective in cleaning the internal surfaces of said automotive cooling system.

6. A process according to claim 2 wherein the flushing agent is effective in cleaning the internal surfaces of the automotive cooling system.

7. A process for flushing/filling an automotive cooling system containing an antifreeze/coolant first liquid, wherein such process comprises using a flushing apparatus comprising in combination a pumping means, liquid switching means, an elongated hollow tubular member and an automobile having an automobile radiator having a neck opening and an over-flow container, said neck opening and said over-flow container containing an antifreeze/coolant first liquid, to be replaced with an antifreeze/coolant second liquid, wherein said elongated hollow tubular member forms an elongated open fluid passageway extending into the automobile radiator through said neck opening for accessing said antifreeze/coolant first liquid, one end of the elongated hollow tubular member adapted to engage a connecting means in a fluid tight relationship to connect the said elongated tubular member to said pump means and switching means and for removing said first liquid and for introducing said second liquid through said elongated hollow tubular member to said automobile radiator, said process comprising:

a) removing at least a portion of the antifreeze/coolant first liquid from the automotive cooling system through said elongated hollow tubular member using said pumping means connected to said liquid switching means;

b) introducing a flushing agent into said automotive cooling system;

c) running said automobile for a selected period of time;

d) removing a substantial portion of said first liquid and flushing agent from said automotive cooling system through said elongated hollow tubular member using said pumping means and switching means;

e) introducing a substantially neutral liquid to said automotive cooling system;

f) removing a substantial portion of said substantially neutral liquid from said automotive cooling system through said elongated hollow tubular member using said pumping means and switching means; and g) introducing said antifreeze/coolant second liquid to said automotive cooling system through said elongated hollow tubular member using said pumping means and switching means.

8. The process of claim 7 wherein the substantially neutral liquid is water.

9. A cleaning process for an automotive cooling system using a flushing apparatus having pumping means, switching means, an elongated hollow tubular member connected to said pumping and switching means for use with an automotive cooling system containing a first liquid to be replaced with a second liquid and said automotive cooling system having a radiator having an open neck opening into which at least one elongated hollow tubular member is inserted, wherein said cleaning process comprises: inserting an elongated hollow tubular member into the automobile radiator through the neck opening for accessing said first liquid; employing said pumping means and switching means for alternating between removing a portion of said first liquid through said open neck opening of said automobile radiator through an elongated hollow tubular member and replacing said removed first liquid by introducing said second liquid through an elongated hollow tubular member into said automotive cooling system through said open neck opening of said automobile radiator.

10. A process according to claim 9 wherein a major amount of said first liquid is removed.

11. A process for flushing/filling an automotive cooling system using a flushing apparatus comprising in combination pumping means, liquid switching means an elongated hollow tubular member connected to said switching means and an automobile radiator having a neck opening, said automobile radiator containing a first liquid to be replaced with a second liquid wherein said elongated hollow tubular member is introduced through said neck opening to form an elongated open fluid passageway into the automobile radiator for accessing said first liquid, one end of the elongated hollow tubular member adapted to engage the switching means in a fluid tight relationship, such pumping means in communication with said switching means for removing a major amount of said first liquid from said automotive cooling system through said elongated hollow tubular member and for introducing said second liquid through said elongated hollow tubular member, said process comprising:

a) removing said first liquid from said automobile radiator through said elongated hollow tubular member; and b) introducing said second liquid to said automobile radiator through said elongated hollow tubular member.

12. A process according to claim 11 where said process additionally comprises the following steps:

a) removing said antifreeze/coolant first liquid from said automotive cooling system through said elongated hollow tubular member;

b) introducing a cleaning liquid or a substantially neutral liquid into said automotive cooling system;

c) removing said cleaning liquid or said substantially neutral liquid from said automotive cooling system through said elongated hollow tubular member; and d) introducing said antifreeze/coolant second liquid to said automotive cooling system through said elongated hollow tubular member.

13. A process according to claim 12 wherein said substantially neutral liquid is water.

14. A process according to claim 12 wherein said cleaning liquid is a flushing agent.

15. A process according to claim 14 wherein said flushing agent is effective in cleaning the internal surfaces of said automotive cooling system.

16. A process according to claim 12 wherein said flushing agent is effective in cleaning the internal surfaces of said automotive cooling system.

17. A process for flushing/filling an automobile having an automotive cooling system containing an antifreeze/coolant using a flushing apparatus in combination with pumping means, switching means, connecting means, elongated hollow tubular member and an automobile comprising an automobile radiator having a neck opening and an over-flow container, said neck opening and said over-flow container containing an antifreeze/coolant first liquid to be replaced with an antifreeze/coolant second liquid wherein the flushing apparatus comprises an elongated hollow tubular member forming an elongated open fluid passageway and extending into the neck opening of said automobile radiator for accessing and removing said antifreeze/-coolant first liquid, and for introducing said second liquid through said elongated hollow tubular member into said automobile radiator said process comprising:

a) removing at least a portion of said antifreeze/coolant first liquid from said automotive cooling system using said pumping means and said switching means until said over-flow container is substantially empty;

b) introducing a flushing agent into said over-flow container;

c) removing an additional portion of said antifreeze/-coolant first liquid and flushing agent from said automotive cooling system through said elongated hollow tubular member until said flushing agent in said over-flow container is introduced into said automotive cooling system;

d) running the automobile for a selected period of time;

e) removing a substantial portion of said antifreeze/-coolant first liquid and flushing agent from said automotive radiator through said elongated hollow tubular member;

f) introducing a substantially neutral liquid to said automotive cooling system;

g) removing a substantial portion of said substantially neutral liquid from said automotive cooling system through said elongated hollow tubular member;

h) introducing said antifreeze/coolant second liquid to said automotive cooling system through said elongated hollow tubular member using said pumping means and switching means until said automotive cooling system and over-flow container are substantially full.

18. The process of claim 17 wherein the substantially neutral liquid is water.

19. A cleaning apparatus for an automotive cooling system comprising in combination a pumping means, switching means and at least one elongated hollow tubular member for use in removing and introducing liquids from and to an automotive cooling system containing a first liquid to be replaced with a second liquid and having a radiator with a radiator neck opening wherein an elongated hollow tubular member forms an elongated open fluid passageway and extends into the automobile radiator through the radiator neck opening for accessing said first liquid; connecting means connected to one end of an elongated hollow tubular member for connection to pumping means having liquid switching means and said connecting means being adapted to engage said elongated tubular member in a fluid tight relationship; and said pumping means connected to said liquid switching means for alternating between removing first liquid from said automobile radiator through an elongated hollow tubular member and replacing said removed first liquid by introducing said second liquid through an elongated hollow tubular member into said automotive cooling system.

* * * * *